US008562301B2

(12) United States Patent
Jan et al.

(10) Patent No.: US 8,562,301 B2
(45) Date of Patent: Oct. 22, 2013

(54) TURBINE BLADE RETENTION DEVICE

(75) Inventors: Shihming Jan, Solana Beach, CA (US); David Carlton Hansen, Vista, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 784 days.

(21) Appl. No.: 12/763,409

(22) Filed: Apr. 20, 2010

(65) Prior Publication Data

US 2011/0255982 A1 Oct. 20, 2011

(51) Int. Cl.
*F01D 5/30* (2006.01)

(52) U.S. Cl.
USPC ..... 416/204 R; 416/215; 416/219 R; 416/220 R; 416/221; 29/889.1; 29/889.2; 29/889.21

(58) Field of Classification Search
USPC ..... 416/204 R, 215, 219 R, 220 R, 221; 29/889.1, 889.2, 889.21
See application file for complete search history.

(56) References Cited

U.S. PATENT DOCUMENTS 2,786,648 A * 3/1957 Ledwith ..... 416/221
2,847,187 A * 8/1958 Murphy ..... 416/221
2,928,651 A * 3/1960 Turnbull ..... 416/221
3,383,095 A * 5/1968 Anderson ..... 416/220 R
3,720,480 A * 3/1973 Plowman et al. ..... 416/220 R
4,236,873 A 12/1980 Sherman et al.
4,730,983 A 3/1988 Naudet et al.
4,872,810 A 10/1989 Brown et al.
5,151,013 A 9/1992 Moore
5,173,023 A 12/1992 Pawlowski et al.
5,261,790 A 11/1993 Dietz et al.
H1258 H 12/1993 Hindle, Jr.
5,281,097 A 1/1994 Wilson et al.
5,518,369 A 5/1996 Modafferi
5,913,660 A 6/1999 Knott
5,984,639 A 11/1999 Gekht et al.
6,109,877 A * 8/2000 Gekht et al. ..... 416/221
7,415,763 B2 * 8/2008 Miosga et al. ..... 29/889.21
8,113,784 B2 * 2/2012 Gupta ..... 416/193 A

* cited by examiner

*Primary Examiner* — Igor Kershteyn
(74) *Attorney, Agent, or Firm* — Carlson, Gaskey & Olds, P.C.

(57) ABSTRACT

A turbine blade assembly has a turbine blade with a root section and an airfoil section. The root section has one of a radially extending groove or flange, and a retainer element has the other of the groove and the flange. The groove receives the flange to hold the retainer element and the blade together. The retainer element has axial ends extending radially inwardly to secure a turbine blade assembly within a disk slot in a turbine rotor disk. A method is also disclosed.

8 Claims, 2 Drawing Sheets

36
38
32
33
34
24
26
27
30
20
136
4B
4B 22
127

TURBINE BLADE RETENTION DEVICE

BACKGROUND

This application relates to a retainer element for holding turbine blades in a turbine rotor disk slot.

Gas turbine engines are known and typically include a compressor for compressing air. The compressed air is delivered into a combustion chamber, mixed with fuel and combusted. Products of this combustion pass downstream over turbine rotors, driving the rotors to rotate.

The turbine rotors typically carry a number of turbine blades which are precisely designed, and include a root with a number of ears which interfit in slots in a rotor disk. In some applications, the blades are simply slid into the slots.

The disks are subject to high temperatures, high speed rotation, and it is important to keep the turbine blades properly positioned on the disks. For this reason, various retainer elements have been developed. However, there are deficiencies in each of these retainer elements.

SUMMARY

A turbine blade assembly has a turbine blade with a root section and an airfoil section. The root section has one of a radially extending groove or flange, and a retainer element has the other of the groove and the flange. The groove receives the flange to hold the retainer element and the blade together. The retainer element has axial ends extending radially inwardly to secure the turbine blade assembly within a disk slot in a turbine rotor disk. A method is also disclosed.

These and other features of the present invention can be best understood from the following specification and drawings, the following of which is a brief description.

DETAILED DESCRIPTION

Figure 1:
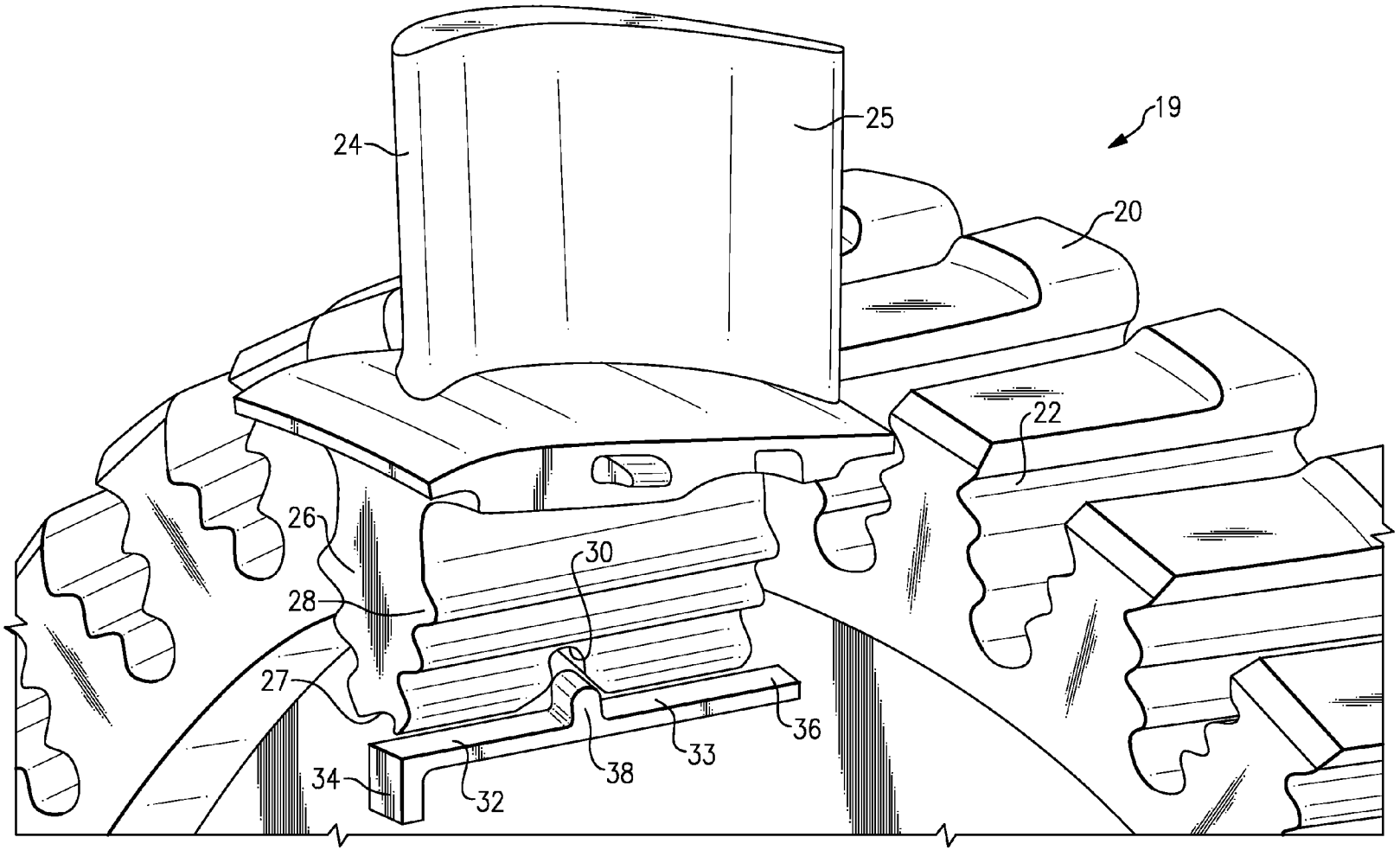
FIG. 1 is an exploded view of a turbine disk and blade.

A turbine rotor 19 is illustrated in FIG. 1 having a disk 20 centered on an axis, and including a plurality of eared slots 22. A blade 24 has an airfoil 25, and is shown removed from the slot 22. As known, root portion 26 of the blade 24 has ears 28 that fit into the slot 22 to position the blade 24 on the disk 20. As shown, there are a plurality of slots 22, and a blade 24 would typically be received in each slot 22.

A bottom channel 27 is formed at a radially innermost end of the blade 24. Further, a positioning groove 30 is formed in a generally central location on the radially innermost end of blade 24.

A retainer element 32 is positioned such that an elongate body portion 33 is positioned in the channel 27. A positioning flange 38 is received within the groove 30. A first end 34 is formed to extend radially inwardly relative to the disk 20. A second end 36 is initially formed to extend straight with the body 33. Although FIG. 1 depicts the groove 30 radially extending in the root portion 26 and the flange 38 radially extending on the retainer element 32, it will be understood that the groove 30 can be radially extending in the retainer element 32 and the flange 38 can be radially extending on the root portion 26.

In one embodiment, the retainer element 32 is formed of a high temperature, high strength nickel-based alloy. The retainer element 32 may be fabricated by unconventional machining processes such as electric discharge machining (EDM) or laser. However, other processes and materials may be utilized to form the retainer element 32. The retainer elements 32, along with all elements in the turbine rotor 19, should be capable of providing high strength at very high temperature (e.g., 1100° F. (600° C.)).

Figures 2, 3A, 3B, 4A, 4B:
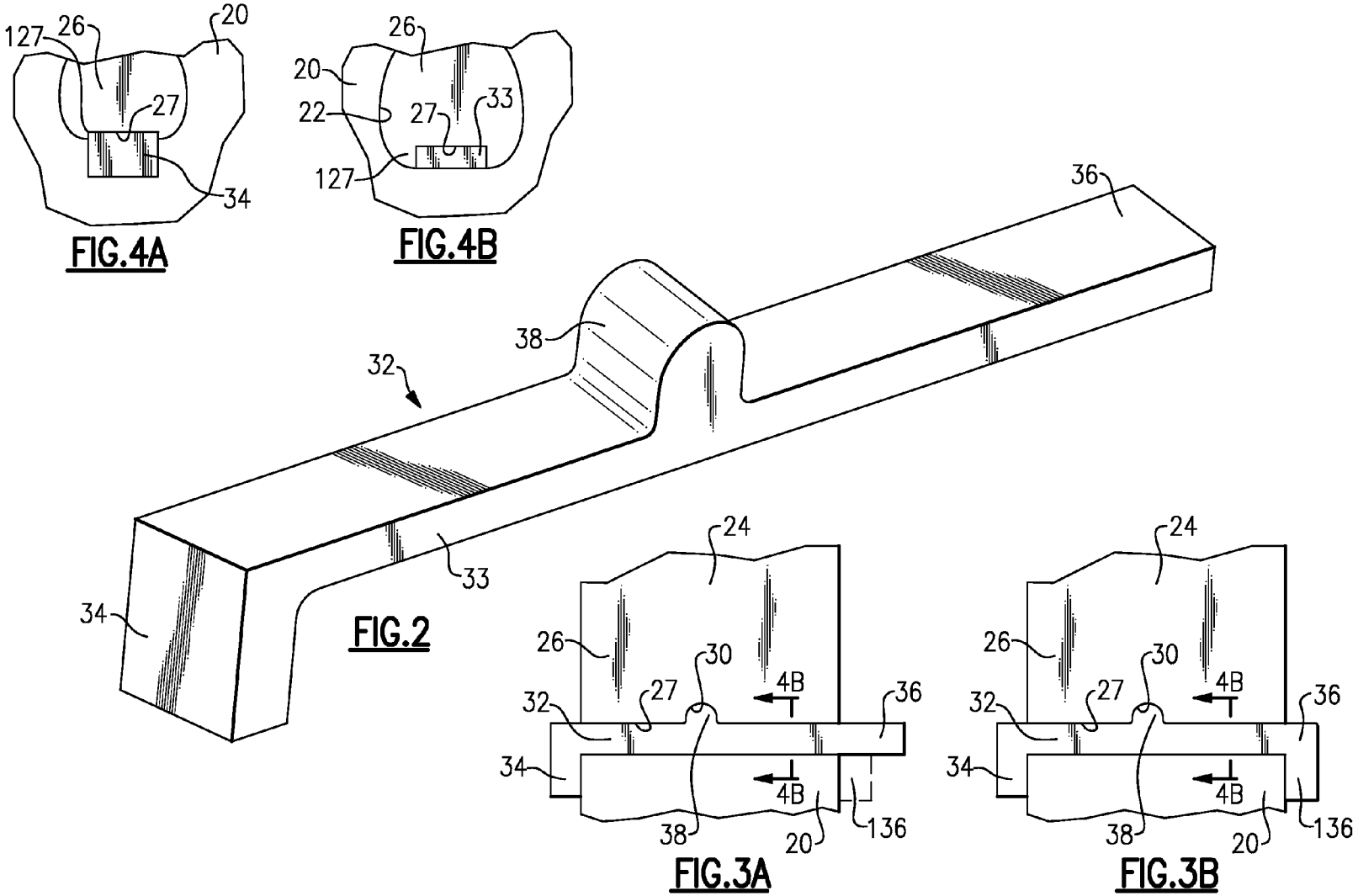
FIG. 2 shows a retention device.
FIG. 3A shows a step in assembling the retention device.
FIG. 3B shows a subsequent step.
FIG. 4A is an end view.
FIG. 4B is a second cross-sectional view.

As shown in FIG. 2, the retainer element 32 has its flange 38 at a generally central location. It should be understood that flange 38 is not necessarily at an exact center point, but should simply be positioned somewhat centrally such that it can be received at a generally central location in the bottom of the root 26, and in the groove 30. To assemble the blade 24 to the disk 20, one initially places the retainer element 32 into the groove 30, and with body portion 33 in channel 27. The assembled blade and retainer may then be slid into a slot 22.

As shown in FIG. 3A, after the blade 24 is initially received in the slot 22, the end 34 abuts a first end of the disk 20. At this time, the other end 36 extends outwardly and beyond the opposed end of the disk 20.

As shown in FIG. 3B, the end 36 is then deformed radially inwardly, as shown at 136 in phantom in FIG. 3A and as shown in FIG. 3B. At that point, the retainer 32 now retains the blade 24 within the slot 22. The flange 38 ensures the blade 24 does not move relative to the retainer, and the retainer itself cannot move relative to the disk 20, due to the ends 136 and 34.

As can be appreciated from FIGS. 3A and 3B, the channel 27 extends between axial ends of the blade 24. The groove 30 is located over a small generally central portion of the radially inner end of the root portion 26 of the blade 24.

As shown in FIG. 4A, the end 34 extends radially inwardly of the channel 27. The channel 27 is positioned only at a generally circumferentially central portion of the root 26, and there are ends 127 at each circumferential side of the channel 27.

FIG. 4B shows a generally central location, and shows that the body portion 33 of the retainer element 32 is generally of the same thickness as a radial depth of the channel 27.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A turbine blade assembly comprising:

a turbine blade including a root section and an airfoil;

said root section including a radially extending groove and flange;

a retainer element including a flange, with said groove positioned in said flange to hold said retainer element and said turbine blade together, and said retainer element including axial ends which extend radially to secure said turbine blade and said retainer element assembled within a disk slot in a turbine rotor disk;

said groove extends into said root section of said blade;

a channel formed in a radially innermost end of said root section, said channel receiving a body portion of said retainer element;

said root section including two axial ends, and said channel extends between said two axial ends of said root section; and said retainer element including a first end which is formed to extend radially inwardly, and a second end which is deformed radially inwardly after said assembly is positioned within a disk slot.

2. The assembly as set forth in claim 1, wherein said groove extends into said root section at a radially innermost end of said root section.

3. The assembly as set forth in claim 1, wherein said groove is positioned spaced between said two ends.

4. The assembly as set forth in claim 1, wherein said channel does not extend between circumferential sides of the root section, but instead there are circumferential ends of the root section defined at each of two circumferential sides of the channel.

5. The assembly as set forth in claim 4, wherein said body portion is of the same thickness as a radial depth of said channel.

6. A turbine blade assembly comprising:

a turbine blade including a root section and an airfoil;

said root section including a radially extending groove;

a retainer element including a radially extending flange, with said groove positioned in said flange to hold said retainer element and said blade together, and said retainer element including axial ends which extend radially to secure an assembled blade and retainer element within a disk slot in a turbine rotor disk;

said groove extending into said root section of said blade;

said groove extending into said root section at a radially innermost end of said root section;

a channel formed in said radially innermost end of said root section, said channel receiving a body portion of said retainer element;

wherein:

said root section extends between two axial ends, and said channel extends between said two axial ends;

said channel is positioned spaced between said two axial ends; and said retainer element includes a first end formed to extend radially inwardly, and a second end which is deformed radially inwardly after said assembly is positioned within a disk slot.

7. The assembly as set forth in claim 6, wherein there are circumferential ends of the root section defined at each of two circumferential sides of the channel, and said body portion is of the same thickness as a radial depth of said channel.

8. A method of assembling turbine blades within a turbine disk comprising:

(a) positioning a blade including a groove and a retainer element including a flange such that said flange is positioned in said groove to hold said blade and said retainer element together;

(b) sliding said blade and said retainer element into a slot in a turbine disk;

(c) deforming at least a portion of said retainer element radially to secure said retainer element to said turbine disk, and to secure said blade in said slot;

said retainer element including two ends, and the deformation includes deforming one of said two ends radially inwardly; and one of said two ends already extends radially inwardly when the positioning of step (a) occurs, and step (c) only includes deforming the other of said two ends radially inwardly.

* * * * *